US005590760A

United States Patent [19]

Astarb

[11] Patent Number: 5,590,760

[45] Date of Patent: Jan. 7, 1997

[54] CRUSH-HEAT RESISTANT CASE FOR SPECTACLE PROTECTION

[76] Inventor: Nicholas L. Astarb, P. O. Box 181, Weyers Cave, Va. 24486

[21] Appl. No.: 364,254

[22] Filed: Dec. 27, 1994

[51] Int. Cl.[6] ..... B65D 81/02; B65D 85/18

[52] U.S. Cl. ..... 206/6; 206/5; 206/594; 383/86; 383/111

[58] Field of Search ..... 206/5, 521, 6, 206/594; 2/247; 383/86, 109–111, 114, 117, 120

[56] References Cited

U.S. PATENT DOCUMENTS

| | | | |
|---|---|---|---|
| 2,738,054 | 3/1956 | Baratelli | 206/5 |
| 2,909,276 | 10/1959 | Stegeman | 206/5 |
| 3,038,593 | 6/1962 | Root et al. | 206/5 |
| 3,050,181 | 8/1962 | Nathan | 206/5 |
| 3,276,572 | 10/1966 | Everburg | 206/5 |
| 3,994,391 | 11/1976 | Holland | 206/5 |
| 4,823,943 | 4/1989 | Chang | 206/5 |
| 4,984,682 | 1/1991 | Cummins | 206/5 |
| 5,361,412 | 11/1994 | Perry | 2/247 |

*Primary Examiner*—Jimmy G. Foster
*Attorney, Agent, or Firm*—Sheldon H. Parker

[57] ABSTRACT

A case is disclosed for protecting small objects, such as glasses, by providing heat and breakage resistance. The case has an exterior pocket, with a drainage area; a protective case; and a liner. The exterior pocket consists a pocket flap, a body front, and a pair of gussets. The pocket flap is provided with closure means to secure the pocket flap to the body front. The protective case is a rigid, hollow, non-circular cylinder having one closed end and dimensioned to provide a friction fit within the pocket. The protective case can be formed from mirror image halves provided with sealing seams which extend at right angles to the cylinder and a first to break point. The liner is a hollow, non-circular cylinder manufactured from a non-abrasive, cushioning material approximately twice the length of the protective case. Optionally, the case is provided with a belt attachment loop to affix the case to a user's belt. It is preferable that all materials meet standards as set forth by the emergency services or industrial application.

12 Claims, 4 Drawing Sheets

CRUSH-HEAT RESISTANT CASE FOR SPECTACLE PROTECTION

BACKGROUND OF THE INVENTION

1. Field of the Invention

This invention relates to cases to carry eyeglasses or small objects generally and more particularly to cases which are lightweight, heat and crush resistant, and meet emergency industry standards.

2. Brief Description of the Prior Art

Persons working in the emergency services or the industrial field at times must wear masks, helmets and other related gear that does not permit the use of sunglasses or eyeglasses. Their glasses must be put in a safe place for protection from the sometimes harsh work place environment while using this equipment. Persons working in this type of environment must either place their eyeglasses outside of the work area or place them in a case. Cases presently used, are generally made from soft construction and are not inherently crush resistant making them unsuitable for the emergency service worker or the industrial worker. Firefighters for example do not have a case available to them to protect their glasses from extreme heat, cold and other harsh and damaging forces.

U.S. Pat. No. 3,038,593 to Root discloses a protective device for providing protection of articles, such as glasses, during shipping. The container 10 is manufactured from a flexible material which maintains its shape through the use of a volatile substance such as liquid nitrogen. Although effective for shipping, the container 10 cannot be used as a glasses case where repeated access is required.

U.S. Pat. No. 3,276,572 to Everburg provides an expandable/collapsible eyeglass case. The concept of the Ever- burg patent is to eliminate the space taken by the eyeglass case when the glasses are being worn. To do this, the Everburg case must be flexible and therefore unable to provide protection for the glasses.

Accordingly, it is the object of the present invention to provide a heat, cold and crush resistant spectacle case for the emergency service worker, industrial worker, sportsman, or any other related field application.

A more specific object is to provide a heat, cold and crush resistant spectacle case, which is lightweight, meets industry standards, and can be easily mounted to the persons clothing. Keeping the glasses clean, unharmed and convenient will make for a safer and more efficient work atmosphere.

These and other objects are accomplished in one preferred embodiment of the invention wherein a pocket is provided with a protective case with an elongated body having sides, a rounded bottom and an opening at its top to accommodate the insertion of a liner. A liner is provided with an elongated shape having sides, a bottom and an opening at its top. The liner is inserted into the protective case then doubled over the edge of the protective case and secured at its bottom with a hook & loop closure system. The protective case and liner component are now placed into the pocket. The pocket is a generally square body having sides, a bottom and an opening at its top, covered by and extended closure flap. The closure flap is provided with a hook & loop closure system to secure and close the pocket. The pocket is then sewn into place on the persons work clothing at their desired location. The spectacle case can also be used can also be used as a belt mount model if that is the application desired. The liner and protective case remain in the pocket as an integral part of the spectacle case. The liner and the protective case can be removed for cleaning or replacement if needed.

During use, the flap is raised and the glasses placed in the liner portion of the spectacle case and the flap closed. When needed, the user raises the flap and retrieves their glasses from the liner portion of the spectacle case.

SUMMARY OF THE INVENTION

A case for protecting small objects, such as glasses, by providing heat and breakage resistance having an exterior pocket a protective case and a liner is disclosed. The exterior pocket consists a pocket flap, a body front, and a pair of gussets. The pocket flap is provided with closure means to secure the pocket flap to the body front. The pocket is also provided with drainage areas, such as grommets to prevent water from accumulating within the pocket. The protective case is dimensioned to provide a friction fit within the exterior pocket and is preferably manufactured from a rigid, shatter proof material. The liner covers the interior and exterior of the protective case. One of each of the gussets is secured along its length to either length side of the body front, giving a width slightly greater than the width of the body front. When securing the gussets and body front to the pocket flap along the width, pleats are formed between said gussets and said body front to allow for the insertion of said protective case. The protective case is a hollow, non-circular cylinder having one closed end. In one embodiment the open end of said cylinder has a wider dimension than the body of the cylinder. For added rigidity a ridge is provided along the center of the length of the protective case. The non-circular cylinder can be formed from mirror image halves which have sealing seams extending at right angles to the cylinder along all but the open end of the cylinder. The sealing seams provide a first to break point. The liner is a hollow, non-circular cylinder manufactured from a non-abrasive, cushioning material having one closed end. In the preferred embodiment the liner has a length and a width, the length being approximately twice the length of the protective case. The liner preferably has closure means. Optionally, the case is provided with a belt attachment loop to affix the case to a user's belt.

It is preferable that all materials meet standards as set forth by the emergency industry.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
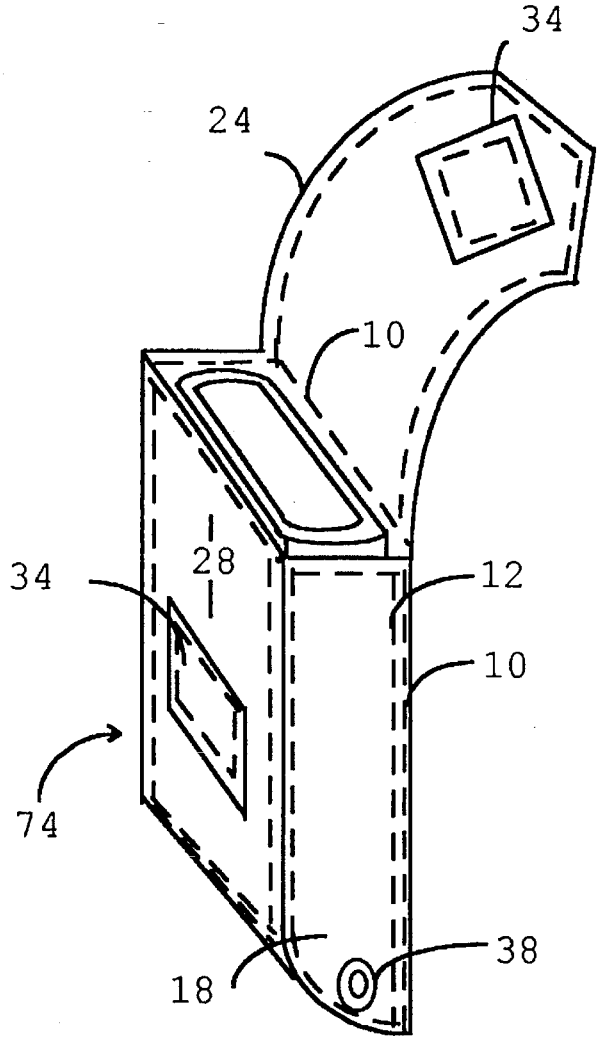
FIG. 1 is a perspective view of the assembled case.

Referring to FIG. 1, a perspective view of the completed spectacle case 74 is illustrated with the protective case 42 and liner 58 combination inserted into the body front 28. The spectacle case 74, as illustrated herein is used for glasses, however, the spectacle case 74 can be used to hold any article which requires protection from the exterior elements. The exterior of the case 74 is manufactured from a flexible material which would be suitable to the end use. In the event the spectacle case 74 is used for emergency service workers, or other industries having special requirements, all materials, such as thread and fabric, must meet the appropriate specifications as known in the art. The spectacle case 74 is comprised of a pocket flap 24, which forms the back and securing portion of the spectacle case 74; gussets 18 and body front 28. The gussets 18 connect the body front 28 to the pocket flap 24 to form what is known in the firefighters industry as a "bellows pocket". The case is stitched together along stitch lines 12. The spectacle case 74 can be readily stitched to the user's clothing by stitching along mounting stitch 10, thereby securing the spectacle case 74 to the clothing along the gussets 18 and pocket flap 24. The mounting stitch 10 serves as the fold line for the pocket flap 24 and should therefore be placed approximately parallel to the open portion of the body front 28 to allow for a neat and even closure. The pocket flap 24 extends beyond the body front 28 by an amount sufficient to allow the pocket flap 24 to be secured to the body front 28. The method of securing the pocket flap 24 to the body front 28, as illustrated herein, is hook and loop fasteners 34. Other means known in the art can be used to secure the pocket flap 24 to the body front 28. It is preferable, however that the fastener be easy to open and close while wearing bulky gloves. Grommets 38, or other drainage means, are placed on either side of the spectacle case 74 to allow for drainage. The grommets 38 are preferably placed in the gussets 18 at the bottom of the spectacle case 74 for maximum efficiency.

Figure 2:
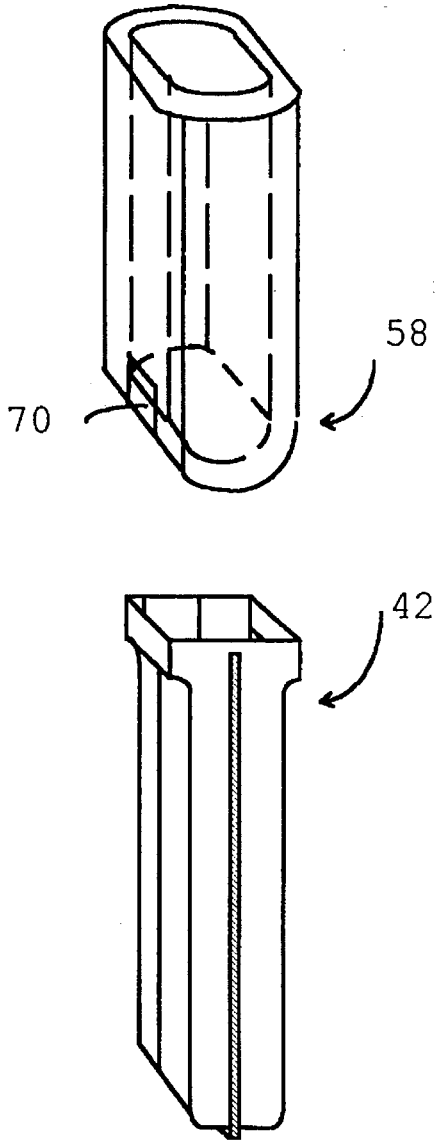
FIG. 2 is an exploded perspective view of the liner and protective case of FIG. 1.
Figure 12:
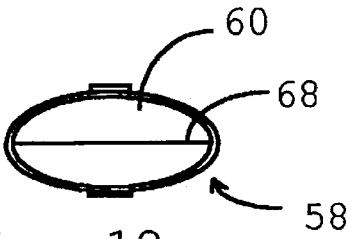
FIG. 12 is a top view of the liner of FIG. 10.
Figure 11:
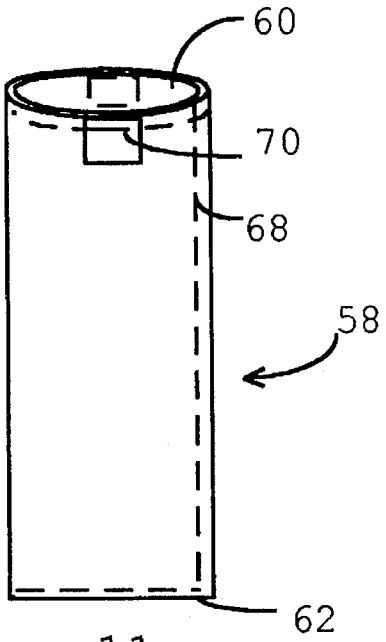
FIG. 11 is a front view of the liner of FIG. 10.
Figure 10:
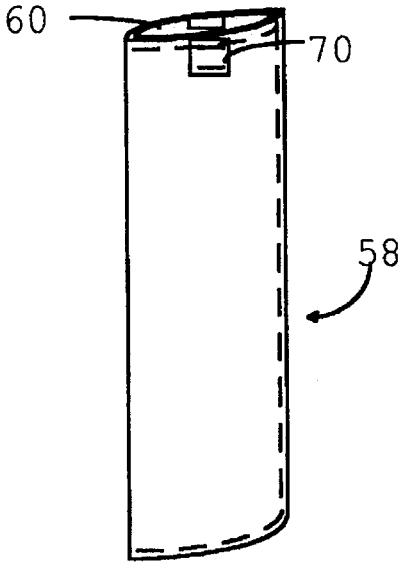
FIG. 10 is perspective view of the liner of the instant invention.

FIG. 2 illustrates the protective case 42 and the liner 58 as they relate to one another before insertion into the spectacle case 74. Liner 58 is manufactured from a soft, thick, non-abrasive fabric to provide thermal protection and cushioning and shown in more detail in FIGS. 10–12. The length of the liner 58 should be slightly greater than twice the height of the protective case 42 to allow for complete coverage of the protective case 42. The liner 58 is stitched along stitch line 68 to form a tube with one end closed. Securing means 70, such as loop and hook fasteners, are preferably included at the open end of the liner 58. To initially insert the liner 58 into the protective case 42, the bottom of the liner 58 is slid into the protective case 42 until the liner bottom 62 comes in contact with the case bottom 52 of the protective case 42. The remaining liner 58 is folded over the outside of the protective case 42, thereby completely covering the inside and outside of the protective case 42. The securing means 70 prevent the liner from sliding up along the protective case 42 during insertion.

The dimensioning between the interior of the spectacle case 74 and the exterior of the liner 58 and protective case 42 must be such that a friction fit is formed. The fit must be sufficiently secure to prevent the liner 58 and protective case 42 from being easily removed when the glasses are removed from the liner 58. The liner 58 and protective case 42 must, however, be removable for cleaning and replacement and cannot, therefore, be permanently affixed to the spectacle case 74.

Figure 3:
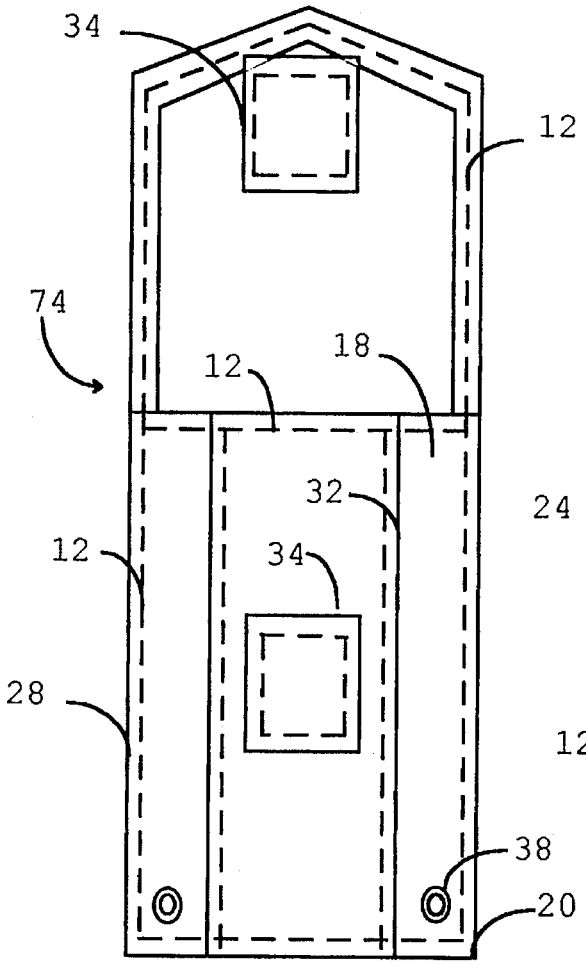
FIG. 3 is a front view of the case of the instant invention in an open position.

FIG. 3 shows the spectacle case 74 in a front view open as when it would be used to insert or remove glasses, or other articles. The proportions between the parts of the spectacle case 74 can more clearly be seen in this figure. Stitch line 12 extends around the entire periphery of all parts of the case, securing the parts together and preventing the edges from fraying. It can more clearly be seen from this figure that the pocket bottom 20 of the spectacle case 74 is formed by stitching the body front 28 and gussets 18 directly to the pocket flap 24. The combination of the gussets 18 and body front 28, when stitched together are wider than the pocket flap 24. This extra width allows for pleats 32 to be created when the gussets 18 and body front 28 are stitched to the pocket flap 24 along the pocket bottom 20. The pleats 32 help provide the needed friction to hold the protective case 42 and liner 58 in the spectacle case 74. The ratio between the gusset 18 and body front 28 combination and the pocket flap 24 is dependent upon the size and configuration of the protective case 42. Critical dimensioning criteria is the ability to easily remove the object contained with the liner 58 without inadvertently removing the liner 58/protective case 42 combination and being able to remove the liner 58/protective case 42 combination when required.

Figure 4:
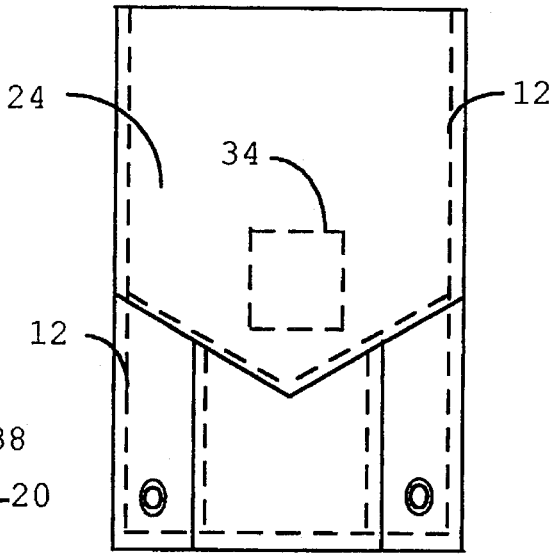
FIG. 4 is a front view of the instant case in a closed position.

The spectacle case 74 is illustrated in FIG. 4 is the closed position and further illustrates the stitch lines 12 and closure means 34. As can be seen, the pocket flap 24 extends to at least the middle of the body front 28. The length of the pocket flap 24 can vary dependent upon end use. In the emergency service worker industry, the flap preferably extends to cover the entire exterior of the body front 28. This provides double fire insulation and meets industry requirements. For other industries, such as hunting, the pocket flap 24 can be at any length which is preferable for manufacture.

Figure 5:
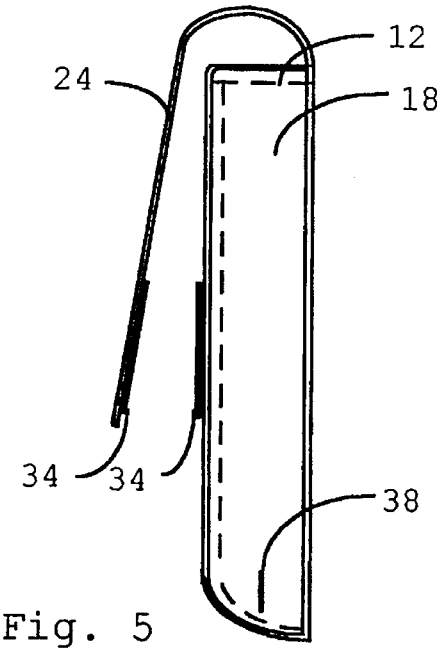
FIG. 5 is a side view of the closed case.

FIG. 5 is a side view of the spectacle case 74 and further illustrates the design of the pocket bottom 20 and gusset 18 expansion during use.

Figure 8:
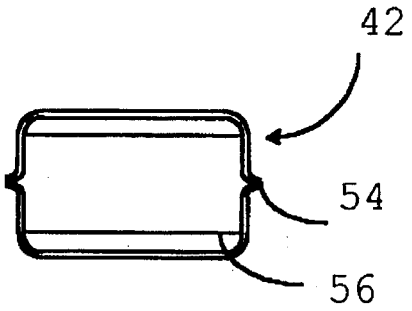
FIG. 8 is a top view of the protective case of FIG. 6.
Figure 7:
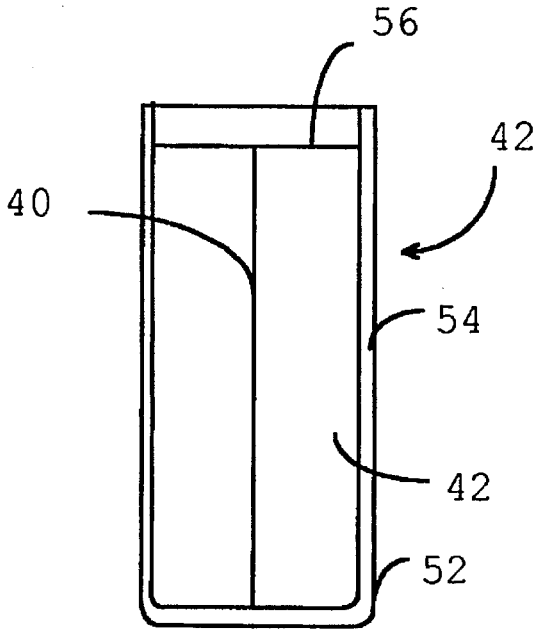
FIG. 7 is a front view of the protective case of FIG. 6.
Figure 6:
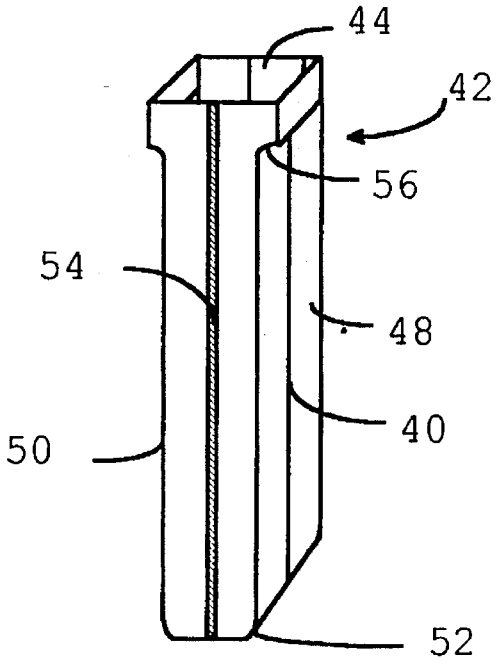
FIG. 6 is a perspective view of the protective case.

FIGS. 6–8 are more detailed views of the preferred construction of the protective case 42. The protective case 42 is constructed from two molded case front pieces 48 and molded case back pieces 50, which can be produced through injection molding or other methods known in the suitable art. The protective case 42 is manufactured from a material, such as polycarbonate resin, which provides sufficient temperature and breakage resistance. Although the material can be altered dependent upon the final use, material which meets these standards are recommended. The case front 48 and case back 50 are are glued together along case seam 54 which extends beyond the plane of the front 48 and back 50. The extended surface created by case seam 54 provides additional strength and glue surface. If the front 48 and back 50 were glued edge to edge, the strength of the protective case 42 would be diminished greatly. The case seam 54 additionally creates a point of first breakage. The point of first breakage provides the advantage that if sufficient pressure is applied to the protective case 42 to break the material, the protective case 42 collapses at the case seam 54 prior to the front 48 and back 50 shattering. The protective case 42 is preferably manufactured with all rounded edges. The use of rounded edges protects the user when pressure is applied during activity. This is especially important is the emergency worker industry where the user may have to crawl along the ground and with the case placed in a position between the user's body and the ground.

The case front 48 and/or case back 50 are preferably provided with a case ridge 40 to provide extra strength. The case ridge 40 should not be so great as to create discomfort for the user, however should be sufficient to provide the added strength. The minimum effective size of the case ridge 40 will be dependent upon materials being used and the end use and will be readily determined by those versed in the art.

The case opening 44 is preferably dimensioned to be wider than the body of the protective case 42. A case bevel 56 is formed to connect the wider case opening 44 to the body of the protective case 42. This wider dimensioning allows for the article to be easily removed or inserted while wearing gloves. The case opening 44 can, alternatively, remain the same dimensions as the front 44 and back 50 of the spectacle case 74.

Figure 13:
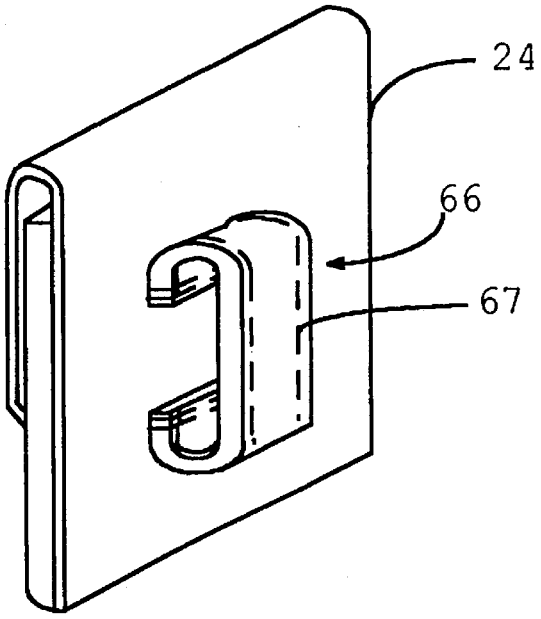
FIG. 13 is a perspective view of the belt mounting device for use with the instant invention.

FIG. 13 illustrates a belt mount 66 which can be affixed to the pocket flap 24 at appropriately the center of the closed spectacle case 74. The belt mount 66 is preferably manufactured from the same material and meeting the same requirements as the spectacle case 74. This is especially applicable in the emergency services industry. The belt mount 66 must have sufficient width to accommodate the sizes and type of belts being worn by the user. The belt mount 66 is stitched along stitch lines 67 and it must be of a thickness sufficient to prevent breakage and/or stretching under stress.

Figure 9:
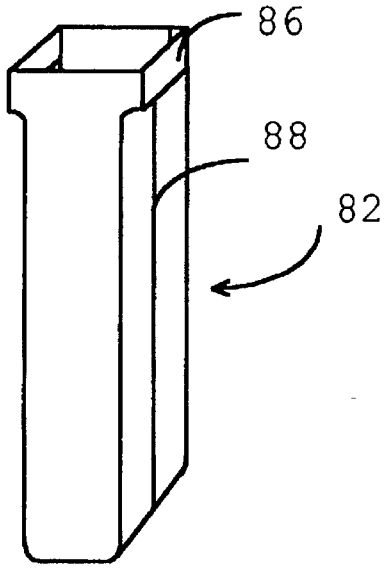
FIG. 9 is a perspective view of an alternate protective case.

An alternate embodiment to the protective case 42 is illustrated in FIG. 9 wherein case 82 is manufactured as a one piece unit. The one piece case can be manufactured through vacuum forming or other means known in the plastics art. Case 82 can also be provided with a wider case opening 86 and ridge 88 as applied to protective case 42. Case 82 is less costly to manufacture in large quantities than the protective case 42. Although one piece units can provide greater structural strength, in some industries the give provided by the breakage may be desirable. To accommodate the need for first point of breakage, as described heretofore, the mold can be constructed to provide a breakage point by thinning the material slightly along the area which would be equivalent to case seam 54. This would allow for the case 82 to have a predictable breakage point.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

| GLOSSARY OF INVENTION |
|---|
| 10 Mounting Stitch |
| 12 Stitch Line |
| 18 Gussets |
| 20 Pocket Bottom |
| 24 Pocket Flap |
| 28 Body Front |
| 34 Closure Means |
| 38 Grommets |
| 40 Case Ridge |
| 42 Protective Case |
| 44 Case Opening |
| 48 Case Front |
| 50 Case Back |
| 52 Case Bottom |

-continued

| GLOSSARY OF INVENTION |
|---|
| 54 Case Seam |
| 56 Case Bevel |
| 58 Liner |
| 62 Liner Bottom |
| 66 Belt Mount |
| 67 Stitch Lines |
| 68 Liner Seam |
| 70 Securing Means |
| 74 Spectacle Case |
| 82 Case |

What is claimed is:

1. A assembly for protecting small objects by providing heat and breakage resistance having an exterior pocket, said exterior pocket having a pocket flap, said pocket flap having a length and a width, a body front, said body front having a length and a width, said length being less than that of said pocket flap and a pair of gussets, said pair of gussets having a length and a width, said length being equal to the length of said body front;

closure means, said closure means securing said pocket flap to said body front, drainage means, said drainage means preventing water from accumulating within said pocket, one of each of said gussets is secured along its length to either length side of said body front, giving a width slightly greater than the width of said body front, wherein securing said gussets and said body front to said pocket flap along the width, form pleats between said gussets and said body front a rigid, shatterproof, protective case, said protective case being a hollow, non-circular cylinder, formed from mirror image halves, having one closed end and dimensioned to fit within said exterior pocket;

a non-abrasive, cushioning liner, said liner being a hollow, non-circular cylinder having one closed end, covering the interior and exterior of said protective case, wherein said liner and protective case are placed within said exterior pocket.

2. The method of protecting small objects by providing heat and breakage resistance comprising, an exterior pocket, said exterior pocket having a pocket flap, said pocket flap having a length and a width, a body front, said body front having a length and a width, said length being less than that of said pocket flap and a pair of gussets, said pair of gussets having a length and a width, said length being equal to the length of said body front, closure means, said closure means securing said pocket flap to said body front, drainage means, said drainage means preventing water from accumulating within said pocket, one of each of said gussets is secured along its length to either length side of said body front, giving a width slightly greater than the width of said body front, wherein securing said gussets and said body front to said pocket flap along the width, form pleats between said gussets and said body front;

a rigid, shatterproof, protective case, said protective case being a hollow, non-circular cylinder, formed from mirror image halves, having one closed end and dimensioned to fit within said exterior pocket;

a non-abrasive, cushioning liner, said liner being a hollow, non-circular cylinder having one closed end, covering the interior and exterior of said protective case;

comprising the steps of:

affixing said pocket to a user's clothing, placing the closed end of the liner into the protective case until the closed end of the liner is in contact with the closed end of the protective case, folding the remaining portion of the liner over the outside of the protective case, affixing said securing means to secure said protective case within said liners, placing said protective case, liner combination into said pocket, placing eye glasses in said protective case, securing said pocket flap to said body front to secure said protective case/liner combination within said pocket.

3. An assembly for protecting small objects by providing heat and breakage resistance, said assembly comprising, an exterior pocket, said exterior pocket having a pocket flap, said pocket flap having a length and a width, a body front, said body front having a length and a width, a pair of gussets, said pair of gussets having a length and a width and connecting said pocket flap and said body front along three sides, closure means, said closure means removably affixing said pocket flap to said body front, a protective case, said protective case having a length and width slightly less than said exterior pocket;

a liner, said liner being dimensioned and positioned to cover the interior and exterior of said protective case and having closure means to secured said protective case within said liner, said liner and protective case being positioned within said exterior pocket, and said gussets being dimensioned to form a friction fit between said protective case and said exterior pocket to prevent slippages between said exterior pocket and said protective case.

4. The assembly of claim 3 wherein said protective case is a hollow, non-circular cylinder having further comprising a closed end and an open end, the dimension of said protective case length being greater than that of said open end or said closed end.

5. The assembly of claim 4 wherein the open end of said cylinder has a wider dimension than the body of said cylinder and has a sufficient interior dimension to accommodate a pair of eye glasses.

6. The assembly of claim 5 wherein said non-circular cylinder is formed from mirror image halves.

7. The assembly of claim 3 wherein each of said mirror image halves further comprises sealing seams, said sealing seams extending at right angles to said cylinder along all but the open end of said cylinder wherein said sealing seams provide a first to break point.

8. The assembly of claim 3 wherein said protective case is manufactured from a rigid, shatter proof material.

9. The assembly of claim 3 wherein said liner is a hollow, non-cicular cylinder having one closed end.

10. The assembly of claim 9 wherein said liner has a length and a width, said length being approximately twice the length of said protective case.

11. The assembly of claim 9 further comprising draining means, said drainage means preventing water from accumulating within said pocket.

12. The assembly of claim 3 wherein said protective case further comprises a ridge along its length to provide greater rigidity.

* * * * *